US008716212B2

(12) United States Patent
Scheda

(10) Patent No.: US 8,716,212 B2
(45) Date of Patent: May 6, 2014

(54) ARTICLE FOR WASHING COLOURED TEXTILES

(75) Inventor: Fabio Scheda, Idice di San Lazzaro (IT)

(73) Assignee: Orlandi S.p.A., Cassano Magnago (IT)

( * ) Notice: Subject to any disclaimer, the term of this patent is extended or adjusted under 35 U.S.C. 154(b) by 27 days.

(21) Appl. No.: 13/266,286

(22) PCT Filed: Nov. 26, 2009

(86) PCT No.: PCT/IB2009/007586
§ 371 (c)(1),
(2), (4) Date: Oct. 26, 2011

(87) PCT Pub. No.: WO2010/061287
PCT Pub. Date: Jun. 3, 2010

(65) Prior Publication Data

US 2012/0065117 A1 Mar. 15, 2012

(30) Foreign Application Priority Data

Nov. 28, 2008 (IT) ..... BO2008A0721
Nov. 28, 2008 (IT) ..... BO2008A0722
Nov. 28, 2008 (IT) ..... BO2008A0723

(51) Int. Cl.
*C11D 17/04* (2006.01)

(52) U.S. Cl.
USPC ..... 510/295; 510/296; 510/438; 510/439; 510/513

(58) Field of Classification Search
USPC ..... 510/295, 296, 438, 439, 513, 515
See application file for complete search history.

(56) References Cited

U.S. PATENT DOCUMENTS

| | | | | | |
|---|---|---|---|---|---|
| 3,694,364 | A * | 9/1972 | Edwards | 510/295 |
| 3,816,321 | A | 6/1974 | Kleinschmidt | |
| 4,882,917 | A * | 11/1989 | Mizusawa et al. | 68/17 A |
| 5,202,045 | A * | 4/1993 | Karpusiewicz et al. | 510/277 |
| 5,863,885 | A * | 1/1999 | Ruggieri et al. | 510/439 |
| 6,846,784 | B2 * | 1/2005 | Engel et al. | 510/120 |
| 2002/0119721 | A1 * | 8/2002 | Panandiker et al. | 442/381 |
| 2003/0158075 | A1 * | 8/2003 | Panandiker et al. | 510/475 |
| 2008/0146481 | A1 * | 6/2008 | Brown et al. | 510/224 |
| 2009/0144913 | A1 * | 6/2009 | Yu et al. | 8/137 |

OTHER PUBLICATIONS

International Search Report for PCT/IB2009/007586, Mailed May 7, 2010, 2 pages.

* cited by examiner

*Primary Examiner* — Lorna M Douyon
(74) *Attorney, Agent, or Firm* — William J. Sapone; Ware Fressola; Maguire & Barber LLP

(57) ABSTRACT

The invention relates to an article for washing textiles able to absorb colorant substances (4) dissolved in the washing fluid (5) constituted by a flat matrix comprising at least a support material and at least an absorbing agent of colorant substances (4) borne by the support material. The flat matrix is folded and/or rolled-up on itself and compressed to define the conformation of the article (1), and in that the folded and/or rolled-up material compressed on itself is able to unfold and/or unroll when the article (1) is placed in contact with the washing fluid (5) in order to enable the article (1), with the unfolded and/or unrolled matrix, to absorb the colorant substances (4) present in the washing fluid (5) by means of the absorbing agent.

9 Claims, 6 Drawing Sheets

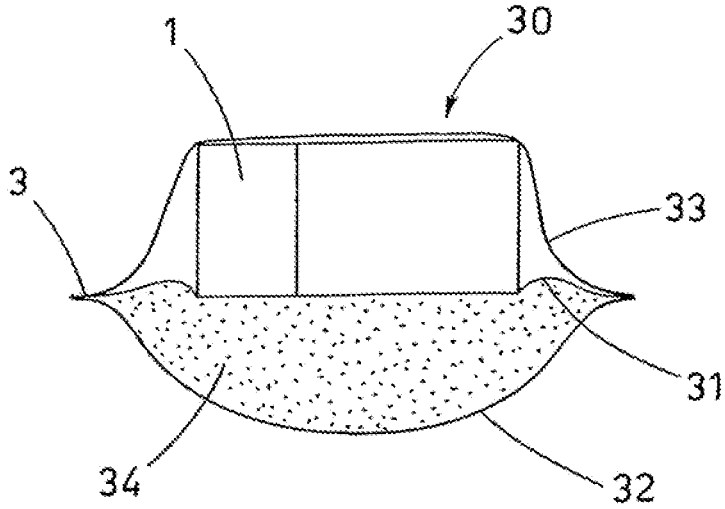
FIG.6
FIG.7
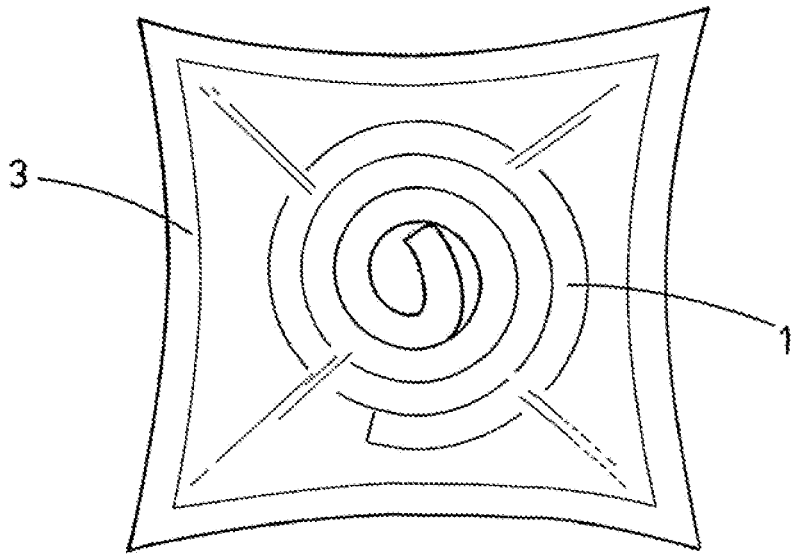

ARTICLE FOR WASHING COLOURED TEXTILES

TECHNICAL FIELD

The invention relates to the field of auxiliary products for washing textiles, in particular coloured textiles.

During washing, whether in a washing machine or manual, coloured textiles tend to release dyes they have been coloured with. This happens more frequently during first washes and represents a drawback which prevents simultaneous washing of articles of different colours or coloured articles with white articles as the colorant substances released by each of these textiles might fix during washing on the other coloured textiles and thus stain them.

BACKGROUND ART

At present articles acting on the principle of absorbing are used, which are placed in the drum of the washing machine during the wash. These limit the presence of colorant substances that may be present in the washing fluid, reducing the probability that these substances can mark or stain textiles of other colours.

These articles are constituted, for example, by a flat porous matrix, which comprises at least a support material and at least an absorbing agent of the dyes in which the absorbing agent is borne on the support material.

Obviously, to clean the textiles usual detergent agents have to be used with the absorbing agents. Optionally there are also present softeners, anti-pilling agents, anti-crease agents, bleaches, anti-limescale, stain removers and the like. This means that the consumer has to avail of a high number of products and has to perform a high number of operations in order to perform an optimum wash of the coloured textiles. Further, there are high costs all along the production chain of products for washing textiles in relation to times and supply costs, transportation volumes and storage, packaging production and costs for elimination of packaging.

At the moment products for cleaning homes (cloths or dusters) constituted by a flat matrix folded randomly or folded several times on a side, spiral-wound and compressed are known. This conformation minimises the volume of the cloths. Following immersion thereof in water the matrix of folded material returns to its original flat form and is ready to perform its special use functions. Typically these cloths are made of a non-woven textile, especially a spongy textile, and exhibit a considerable volume in their original form. The minimum-volume conformation means that they can be transported and stored more easily, with a consequent reduction in the packaging destined to contain them.

In the detergent industry there is however the requirement of optimising transport and storage of articles for washing textiles which are destined to reduce the presence of colorant substances present in the washing fluid.

Further, there is a widespread need to obtain articles for washing textiles for reducing the presence of colorant substances present in the washing fluid which are easily associable to preconstituted and/or loose washing substances having a different action (for example a detergent or a softening action, etc.).

DISCLOSURE OF INVENTION

The main aim of the present invention is to limit the quantity of packaging required in the production of articles for washing textiles, consequently reducing the costs for elimination of the packaging.

A further aim is to enable easy transport and storage of the articles for washing textiles.

A further objective of the invention is to provide an article for washing textiles, in particular coloured textiles, destined to absorb any colorant substances present in the washing fluid, which enables easy association of the articles for washing textiles and preconstituted washing units.

The invention also aims to simplify production of multi-function products (or multiple action products) for washing textiles, in particular coloured articles of clothing, by easy association of the articles aimed at absorbing colorant substances to preconstituted and loose washing units. This would advantageously enable associating the washing units (which carry out a different action, for example detergent, softening, non-matting, whitening, bleaching, anti-creasing, anti-limescale, stain-removing action and the like) which at present can be put on the market as such, to the absorbent article, thus simplifying the management of the warehouse containing the individual products and increasing the versatility of the production according to market demands and optimising transport and storage of the products as well as reducing the number of packages to be eliminated once the multiple-action products have been used.

The above-indicated aims are attained with the article for washing textiles proposed.

The article for washing textiles, especially coloured textiles, is able to absorb colorant substances dissolved in the washing fluid and is constituted by a flat matrix comprising at least a support material and at least an absorbing agent of colorant substances borne by the support material, in which the flat matrix is folded and/or rolled-up on itself and compressed in order to define the conformation of the article, and in that the folded and/or rolled-uped matrix, compressed upon itself, is able to open and/or unroll when the article is placed in contact with the washing fluid in order to enable the article, with the matrix opened and/or unrolled, to absorb the colorant substances present in the washing fluid by means of the absorbing agent.

The unfolding and/or unrolling of the matrix, folded and/or rolled-up on itself and compressed, which is done following contact of the article with the washing fluid, enables the contact surface of the matrix (and therefore of the article) with the fluid to be increased, and makes the article highly effective in absorbing colorant substances present in the washing fluid.

As will be more fully herein below in the description of a preferred embodiment and its use, the proposed article, once the matrix thereof has been unfolded and/or unrolled, can absorb the colorant substances present in the washing fluid by means of the absorbing agent which is at least partially fixed, preferably substantially entirely fixed, to the support material both when the matrix of the article is folded and/or rolled-up and when the matrix is unfolded and/or unrolled and is in contact with the washing liquid.

The article for washing textiles of the invention can be advantageously associated to preconstituted and loose washing units or can be packed in primary packages which contain a multiplicity of these articles. In this way the quantity of waste deriving from packaging is reduced. Alternatively the article for washing textiles can be packed in single packages, at least partially water-soluble, or as reported herein below, the article for washing textiles can be impregnated and/or coated with a water-soluble composition which prevents the matrix from unfolding and/or unrolling in dry environments.

Further advantageous is a package comprising a wrapper at least partially made of a water-soluble material in which the wrapper contains an article for washing textiles of the invention.

The wrapper of the package is preferably entirely made of water-soluble material, inasmuch as once the washing has been done there will be no further packaging to eliminate. The water-soluble material is advantageously biodegradable.

In the following description, and in the claims too, the term "folded" relates to a multiplicity of irregular pleats, or a multiplicity of regular and irregular pleats which can also not extend from one edge to another of the layer, including embodiments which are obtainable by crumpling and/or balling the flat material.

The term "wrapper realised at least partially in water-soluble material" should be taken to mean (in the following description and in the claims too) a packing material which when coming into contact with a textile washing fluid is at least partially dissolved in order to release the article for washing textiles into the environment.

In at least an especially preferred embodiment the support material is advantageously a cellulose material and/or a cellulose derivative. The cellulose material and/or its derivatives give the matrix a greater ability to associate the matrix with the absorbing agent of colorant substances. Thus, with a same flat matrix surface, a greater quantity of the absorbing agent will be fixed on the cellulose support and/or its derivatives, which will increase the absorbent effectiveness of the article of the invention.

BRIEF DESCRIPTION OF THE DRAWINGS

The characteristics of the invention are illustrated with reference to the tables of the drawings in which some preferred embodiments are shown, and in which:

FIG. 6 is a lateral view of a package comprising the article of FIG. 1;

FIG. 7 is a view from above of the embodiment of the package of FIG. 6;

In FIGS. 1 to 15, identical components use the same reference numbers of the following description in the various embodiments of the invention, and will have similar characteristics unless other indications are given.

BEST MODE FOR CARRYING OUT THE INVENTION

The articles of the invention, in which the matrix is flat and porous, are particularly advantageous for washing textiles. In articles for washing textiles in which the flat folded and/or rolled-up matrix is compressed, a greater reduction of the volume of these articles is advantageously obtained.

Figure 1:
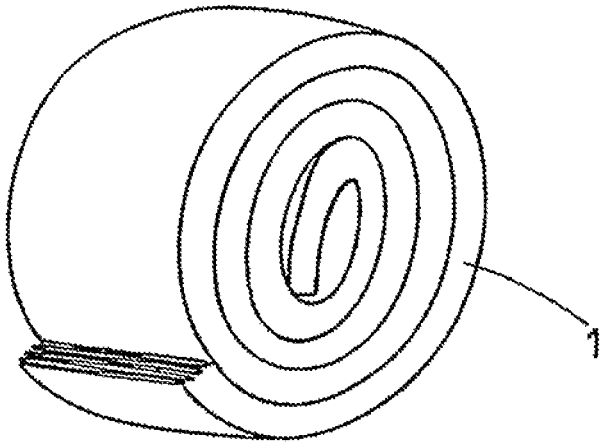
FIG. 1 is an especially enlarged perspective view of an embodiment of the invention.

Articles for washing textiles are preferred in which the flat matrix of the article 1 for washing textiles is folded like a bellows, in particular when it is further rolled-up on itself as illustrated in FIG. 1 and/or further folded on itself. These conformations enable the volume of the article 1 for washing textiles to be further minimised, and enables a more effective unfolding of the matrix.

To optimise the industrial production process of the article of the invention, the matrix is preferably folded and/or rolled-up on itself in a totally random way, with the formation of a multiplicity of irregular pleats, or partially randomly with the formation of a multiplicity of irregular pleats and regular pleats.

Figure 2:
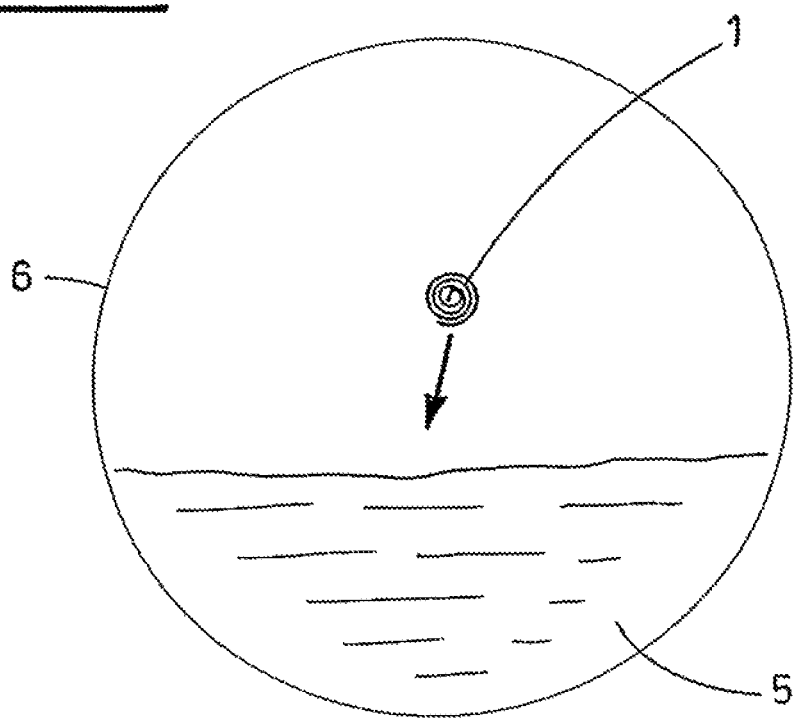
FIG. 2 illustrated the use of the embodiment of FIG. 1 during the washing of coloured textiles in the washing machine.
Figure 5:
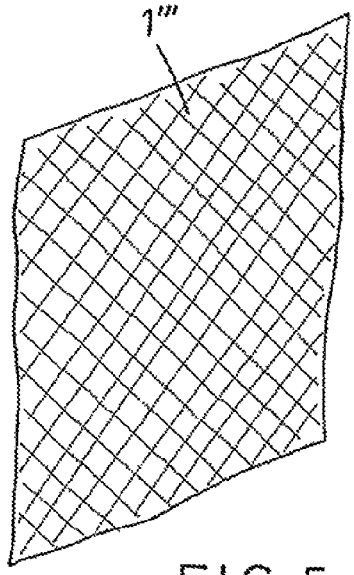
FIG. 5 is a perspective view of the article for washing textiles after use.

Once the article for washing textiles of the invention has been placed in contact with the washing fluid 5, the matrix of the article 1 begins to unfold in order to return to the original planar conformation thereof. To place the article in contact with the washing fluid, the package of the invention can be inserted in the washing fluid 5; the wrapper partially dissolves either partially or entirely according to the embodiment used and the article 1 for washing the textiles is placed in contact with the washing fluid 5. The colorant substances 4 are thus absorbed in the unfolded and/or unrolled matrix of the article 1 by the absorbing agent borne by the support material and at least partially fixed thereto. Thus at the end of the washing cycle, as shown in FIG. 5, the article 1 will have absorbed the colorant substances 4 present in the washing fluid 5 on its unfolded and/or unrolled matrix. Alternatively the article 1 can be placed loose in contact with the washing fluid, placing it for example internally of the basket 6 of a washing machine as illustrated in FIG. 2.

In at least a particularly preferred embodiment, the article 1 for washing textiles is impregnated and/or coated with a water-soluble composition which prevents the matrix from unfolding and/or unrolling in dry environments. When the article 1 is placed in contact with the washing fluid the water-soluble composition, which stabilises the folded and/or rolled-up conformation of the matrix of the article 1 is dissolved and enables the matrix to unroll.

Figure 3:
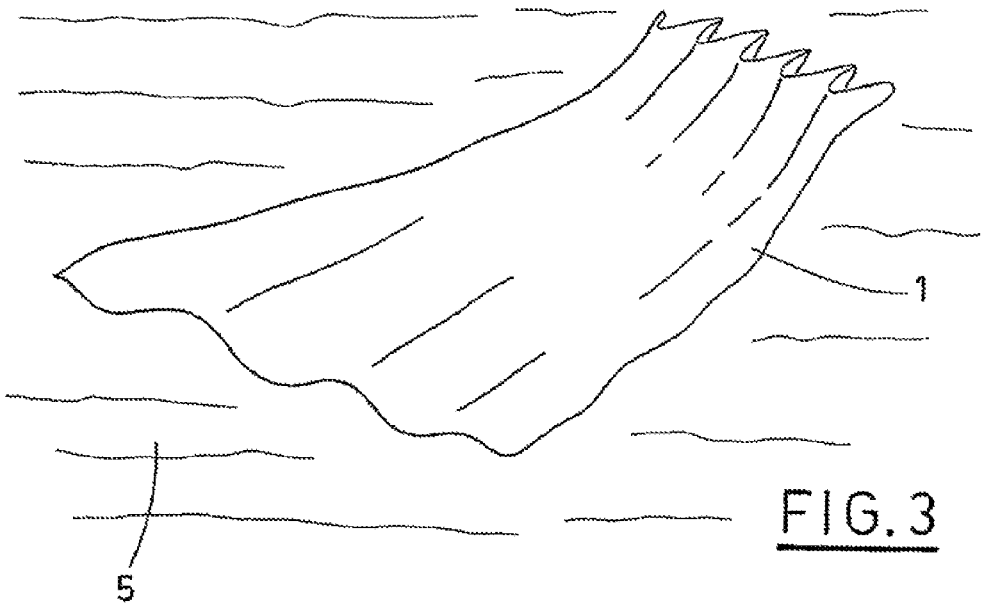
FIG. 3 is a view of the embodiment of FIG. 1 while the matrix of the article for washing textiles unrolls and unfolds.

FIG. 3 shows the matrix of the article 1 for washing textiles of FIG. 1 while it is unroll from a bellows conformation into a flat conformation.

In this flat conformation the absorbing agent of colorant substances 4 borne on the matrix can more effectively perform its absorbent action as the contact surface with the washing fluid 5 is maximised.

Figure 4:
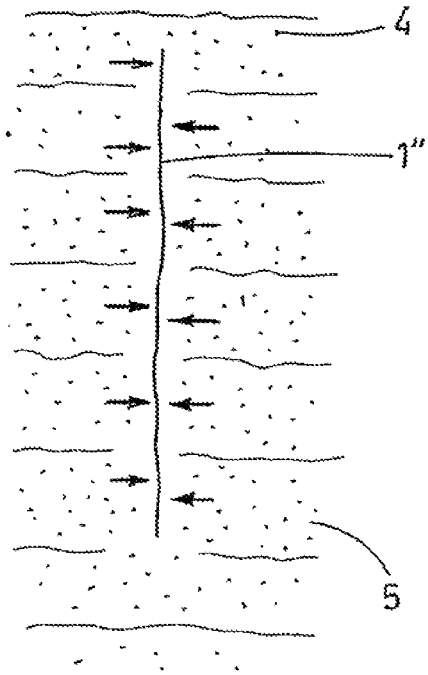
FIG. 4 illustrates the functionality of the article for washing textiles.

The absorbing modes are schematically represented in FIG. 4, in which an article 1" for washing textiles is shown, the matrix of which is entirely unrolled following contact with the washing fluid 5, thus increasing the contact surface thereof and maximising the absorbent effectiveness of the article 1. The colorant substances 4 which during the washing come into contact with the article 1" for washing textiles are preferentially absorbed by the absorbing agent, thus minimising the probability that they will come into contact with the textiles present, and thus be marked or stained.

FIG. 5 shows an article 1'" for washing textiles at the end of its use after having absorbed the colorant substances 4 present in the washing fluid 5. The coloration of the article 1'" schematically illustrated in FIG. 5 is due to the colorant substances 4 which have been fixed to the matrix of the article 1'", unfolded and/or unrolled, by means of the absorbing agent.

It is preferable that the package comprising a wrapper 3 at least partially made of a water-soluble material containing an article 1 for washing textiles of the invention further comprises a composition 34 in liquid, solid or gel form comprising at least a compound selected from a groups constituted by compounds having following actions: detergent, softening, non-matting, whitening, bleaching, anti-creasing, anti-limescale, stain-removing action and the like, in which the composition 34 is located internally of the wrapper 3.

The package enables easy association of the absorbent article 1 with a composition performing a different action during the washing of the textiles. Thus a multi-function product is obtained which is simple to use and is pre-dosed, and which further enables packaging and consequent refuse from packaging to be limited, as well as reducing the volumes of transport and storage of the products for washing textiles.

Preferably, in the package 30 the wrapping 3 has a first and a second housing, separate from one another, the composition 34 being placed in the first housing and the article 1 of the invention being located in the second housing.

FIGS. 6 and 7 illustrate a particularly preferred embodiment of the package, comprising the article of the invention, in which the wrapper 3 comprises a first wall 32, a second wall 31 and a third wall 33, with the first wall 32 and the second wall 31 facing one another and having relative edges reciprocally sealed to define a first housing; the second wall 31 and the third wall 33 facing one another and having relative edges reciprocally sealed to define a second housing, the composition 34 being placed in the first housing and the absorbent article 1 located in the second housing.

In a further embodiment of the wrapper 30, in which one of the two housings contains the other housing, in particular when the second housing contains the first housing, during the use of the wrapper 30, the absorbent article 1 will be already placed in contact with the washing fluid 5, while the first housing is still dissolving or still is to be dissolved. In this way the absorbent article 1 will already be able to absorb the colorant substances 4 before the detergent or the additive contained in the composition 34 can facilitate the dissolving of the colorants the textiles have been dyed with.

Figure 8:
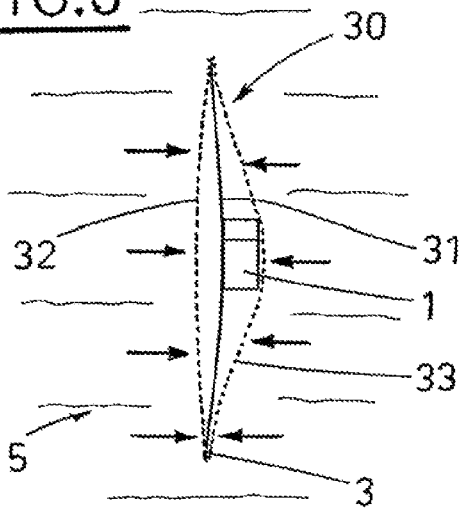
FIGS. 8 and 9 are views of a package of FIGS. 6 and 7 at different and consecutive washing times.
Figure 9:
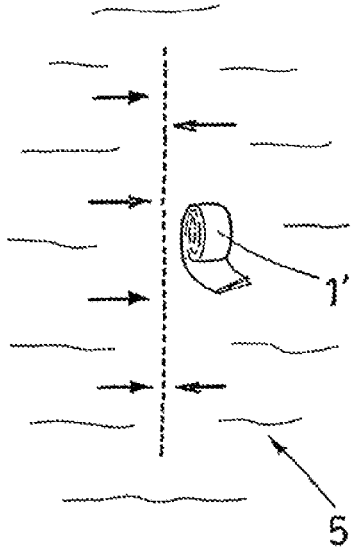

After having placed the wrapper 30 in contact with the washing fluid 5 the wrapping 3 partially or entirely dissolves according to the embodiment used, releasing its content which enters into contact with the washing fluid 5. FIG. 8 schematically illustrates, with a broken line, the external portion of the wrapper 3 as it is dissolving. At this point, as illustrated in FIG. 9, the composition 34 will flow into the washing fluid and at the same time the folded and/or rolled-up matrix of the absorbent article 1' will unfurl. FIG. 9 shows the matrix of the absorbent article 1' as it is starting to unfurl from a bellows conformation to a flat conformation.

The functionality of the absorbent article 1 located internally of the wrapper, once the matrix has entirely unrolled following the contact with the washing fluid 5, is shown in FIG. 4 and at the end of the washing cycle the article 1''' will have the appearance as shown in FIG. 5. It is advantageous to have packages 20 (see FIGS. 10-13) which comprise a wrapper realised at least partially of a water-soluble material in which the wrapper contains an article 1 for washing textiles of the invention and at least a solid element 21 for washing (as shown in FIGS. 10-15) with the solid element 21 being obtainable by aggregation of at least a granular composition and/or power composition comprising at least a composition selected from a group comprising detergent, softening, non-matting, whitening, bleaching, anti-creasing, anti-limescale, stain-removing action and the like.

In at least a particularly preferred embodiment of the package 20 the solid element 21 has at least a housing in which the absorbent article 1 is located, as shown in FIGS. 10-13.

Particularly advantageous is the product 25 for washing textiles of the invention which comprises a solid element 21 for washing obtainable by aggregation of at least a granular and/or powdery composition identifying at least a housing, the composition comprising at least a composition selected from the group constituted by detergent, softening, non-matting, whitening, bleaching, anti-creasing, anti-limescale, stain-removing action and the like; and at least an article 1 of the invention being located in the housing of the solid element 21.

The product 25 for washing can be advantageous packaged in primary packaging containing a multiplicity of the products 25, especially if entirely coated by a water-soluble composition.

Figure 11:
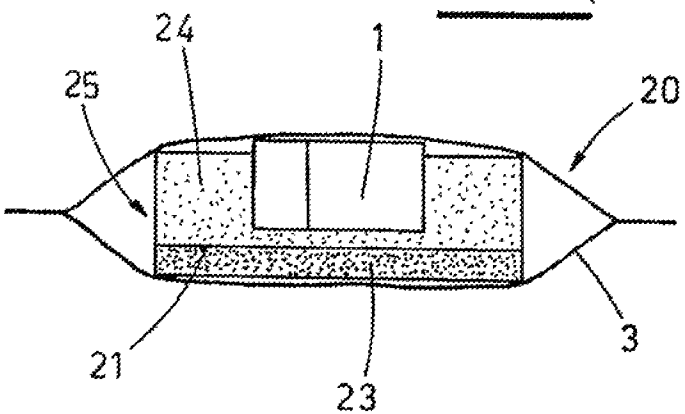
FIG. 11 is a lateral view of the package of FIG. 10.

Also particularly advantageous are embodiments of the package and the product 25 for washing in which the solid element 21 for washing is obtained by aggregation of at least two different granular and/or powder compositions. In this last case it is possible to obtain a solid element 21 for washing which performs various actions as it is made up of compositions having different actions. FIG. 11 shows an embodiment in which the layers 23 and 24 of the solid element 21 have been obtained from different compositions.

Figure 10:
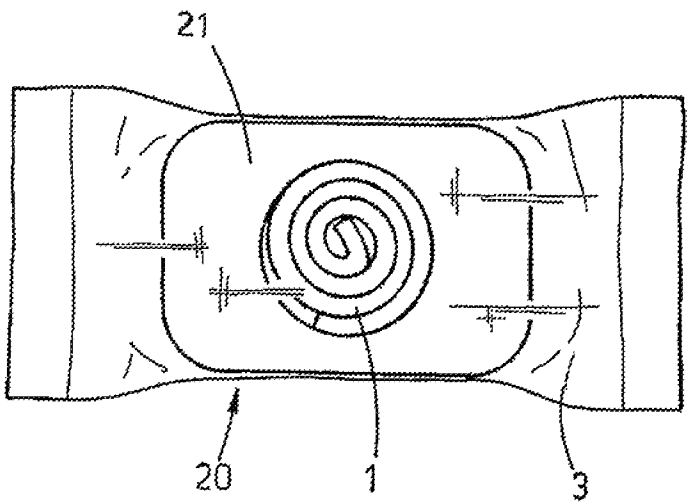
FIG. 10 is a view from above of a further embodiment of a package comprising the article of FIG. 1.

As shown in FIGS. 10 and 11, the package 20 and the product for washing 25 of the invention advantageously have the housing of the solid element 21 accessible from a side of the solid element 21, thus simplifying the insertion operations of the absorbent article 1 into the housing.

Figure 12:
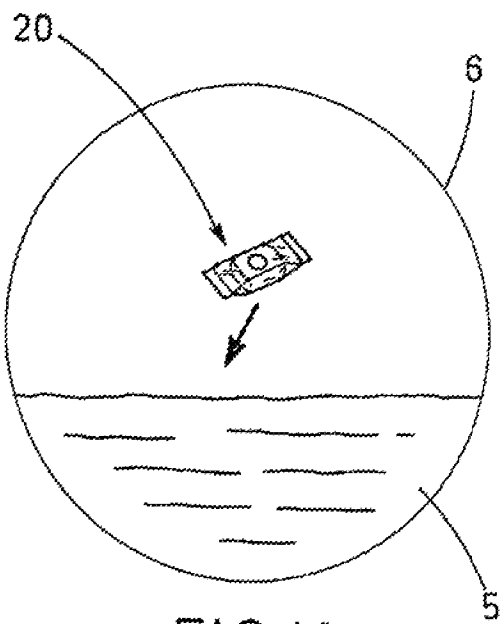
FIG. 12 illustrates the use of the package of FIGS. 10 and 11 during the washing of textiles in a washing machine.
Figure 13:
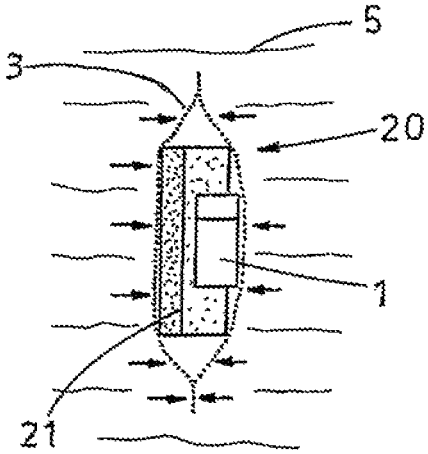
FIGS. 13, 14 and 15 are views of the package of FIGS. 10 and 11 at different and consecutive washing times.
Figure 14:
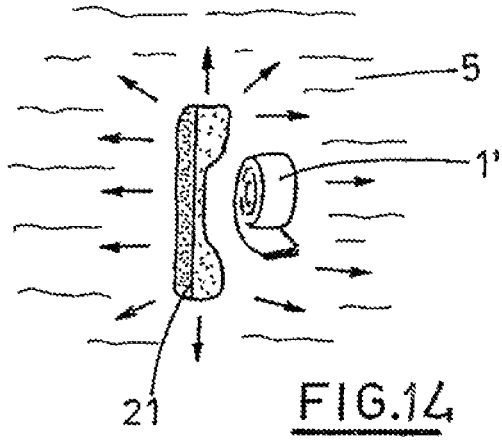

After having placed the package 20 in contact with the washing fluid 5 (placing it, for example, as shown in FIG. 12, internally of drum of a washing machine 6) the wrapper 3 dissolves partially or entirely according to the embodiment used, releasing its contents which then comes into contact with the washing fluid 5. FIG. 13 schematically shows (in a broken line) the wrapper 3 while it is dissolving. At this point, as shown in FIG. 14, the matrix of the absorbent article 1' unfurls while the solid element 21 begins dissolving.

In at least a preferred embodiment, the absorbent article 1 both in the package 20 and the product 25 for washing, is impregnated with and/or coated with a water-soluble composition which prevents the matrix from unfolding and/or unrolling in dry environments. When the article 1 is located in contact with the washing fluid the water-soluble composition, which stabilises the folded and/or rolled-up conformation of the matrix of the article 1, dissolves, enabling the matrix to unfurl.

Figure 15:
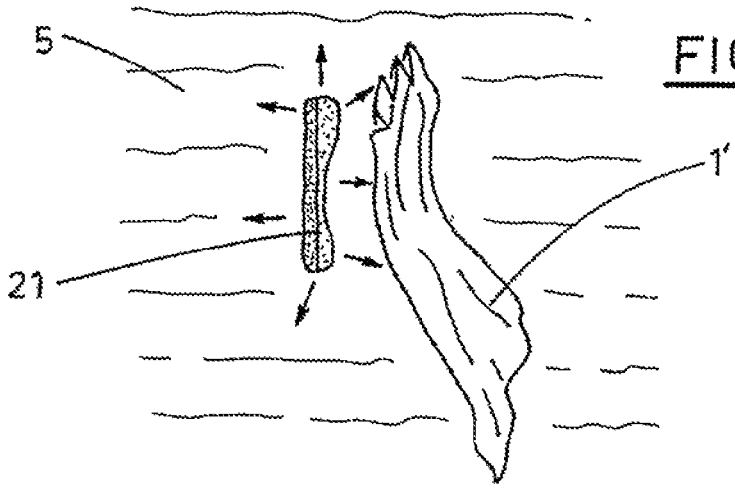

FIG. 15 shows the matrix of the absorbent article 1' while it is unfurling from a bellows conformation to a flat conformation.

In the flat conformation of the matrix the absorbing agent of colorant substances 4 can more efficiently perform its absorbent action.

The absorbing modes of the article 1 inserted in the package 10 are the same as those illustrated in FIG. 4, and at the end of the washing cycle the article 1''' is as illustrated in FIG. 5.

The manufacturing methods of the packages 30 of FIGS. 6-8 and the packages of FIGS. 10-13 are simpler than those for the packages of multi-acting products for washing of the prior art present on the market (not shown) which comprise a wrapper constituted by the matrix internally of which a washing additive is present. This is due to the fact that in order to produce the packages of the invention, differently to the prior art, the above-described matrix is not used as a packaging material, as in itself it is not designed to easily fashion the wrappers of the known packages.

Further, the matrix, being permeable to washing fluids 5, does not guarantee a suitable protection of the additive for washing that it contains.

Further, the known packages, differently from the wrappers of the invention, do not enable easy association of the wrapper later on, constituted by the matrix, with preconstituted washing units which perform a different action during the washing cycle.

The above has been described by way of non-limiting example, and any eventual variants of a practical-applicational nature are understood to fall within the ambit of protection of the invention as described above and in the following claims.

The invention claimed is:

1. An article for washing textiles which is able to absorb colorant substances dissolved in a washing fluid, the article comprising:

a flat matrix having at least one support material and at least one absorbing agent for absorbing the colorant substances, the at least one absorbing agent borne by the support material, the flat matrix being either folded or rolled-up on itself and compressed to define a compressed article, the compressed article becoming uncompressed when the article is placed in contact with the washing fluid in order to enable the article to resume a flat matrix configuration and expose the at least one absorbing agent so as to absorb the colorant substances present in the washing fluid;

a wrapper, made at least partially of a water-soluble material, the wrapper forming a package for containing the compressed article therein;

at least one composition located within the package, the at least one composition selected from a group consisting of a detergent, a softener, a non-matting compound, a whitener, a bleach, an anti-creasing compound, an anti-limescale compound and a stain removing compound; and, wherein the package has at least a first housing and a second housing, separate from one another, the at least one composition being located in the first housing and the compressed article being located in the second housing.

2. The article of claim 1, wherein the support material is composed of a material selected from the group consisting of cellulose and a cellulose derivative.

3. The article of claim 1, wherein the flat matrix is folded or rolled-up on itself along a multiplicity of irregular pleats.

4. The article of claim 1, further comprising a water-soluble composition borne by the flat matrix which prevents the compressed article from becoming uncompressed in dry environments.

5. The article of claim 1, wherein the package has a first wall, a second wall and a third wall, the first wall and the second wall facing one another and having edges thereof reciprocally sealed to define the first housing;

the second wall and the third wall facing one another and having relative edges sealed reciprocally defining the second housing.

6. The article of claim 1, wherein the second housing contains the first housing.

7. The article of claim 1, wherein the at least one composition is in the form of a solid element obtained by aggregation of a powder or granular form thereof.

8. The article of claim 7, wherein the solid element is an aggregation of at least two different granular and/or powder compositions.

9. The article according to claim 1, wherein the wrapper is entirely made of a water-soluble material.

* * * * *